US005772066A

United States Patent [19]

Reynolds

[11] Patent Number: 5,772,066

[45] Date of Patent: Jun. 30, 1998

[54] MULTI-POCKETED COOLER TOTE APPARATUS AND METHOD

[76] Inventor: Martie J. Reynolds, P.O. Box 1104, Apache Junction, Ariz. 85217

[21] Appl. No.: 663,318

[22] PCT Filed: May 3, 1996

[86] PCT No.: PCT/US96/06260

§ 371 Date: Jun. 13, 1996

§ 102(e) Date: Jun. 13, 1996

[87] PCT Pub. No.: WO96/34545

PCT Pub. Date: Nov. 7, 1996

Related U.S. Application Data

[63] Continuation-in-part of Ser. No. 433,839, May 4, 1995, abandoned.

[30] Foreign Application Priority Data

May 4, 1995 [GB] United Kingdom ..... 08/433.839

[51] Int. Cl.[6] ..... B65D 25/00; B65D 25/20

[52] U.S. Cl. ..... 220/694; 220/23.83; 220/735

[58] Field of Search ..... 220/694, 23.4, 220/23.2, 23.86, 23.83, 697, 732, 735, 736, 737, DIG. 10; 150/113, 104; 190/110, 102; 383/39, 38; 206/372, 373; 224/901, 904

[56] References Cited

U.S. PATENT DOCUMENTS

| | | | |
|---|---|---|---|
| 3,675,814 | 7/1972 | Graf | 220/694 |
| 4,356,854 | 11/1982 | McGee | 182/129 X |
| 4,598,803 | 7/1986 | Ghiassi | 190/102 X |
| 4,765,472 | 8/1988 | Dent | 220/23.86 X |
| 4,838,466 | 6/1989 | Holmstrom | 220/737 X |
| 5,174,447 | 12/1992 | Fleming | 220/23.83 X |
| 5,350,081 | 9/1994 | Graham | 220/23.83 X |
| 5,567,055 | 10/1996 | Smith | 190/110 X |
| 5,603,405 | 2/1997 | Smith | 206/373 |

*Primary Examiner*—Allan N. Shoap
*Assistant Examiner*—Niki M. Kopsidas
*Attorney, Agent, or Firm*—Martin & Associates, LLC; Derek P. Martin

[57] ABSTRACT

A cooler tote apparatus can be attached to existing coolers. A tote apparatus (100) for a rectangular cooler (80) in accordance with a first embodiment of the invention includes side panels (120, 122, 124, 126) with elastic portions (110, 112, 114, 116) interposed between and attached to the side panels (120, 122, 124, 126). Side panels (120, 122, 124, 126) may include one or more expandable pockets (130–135). A tote apparatus (300) for a cylindrical cooler (90) in accordance with the first embodiment includes side panels (320, 322) with an elastic portion (310) interposed between and attached to the side panels (320, 322). Side panels (320 322) may include one or more expandable pockets (330, 332).

7 Claims, 3 Drawing Sheets

MULTI-POCKETED COOLER TOTE APPARATUS AND METHOD

RELATED APPLICATION

This patent application is a continuation-in-part of Ser. No. 08/433,839 entitled "Multi-Pocketed Tote Apparatus For Attachment to Coolers and the Like", filed May 4, 1995 now abandoned.

BACKGROUND OF THE INVENTION

1. Technical Field

This invention generally relates to apparatus and methods for toting or carrying things, and more specifically relates to a tote apparatus that attaches to a cooler.

2. Background Art

Containers such as ice chests, insulated jugs, and vacuum bottles have been used for decades to keep a variety of food items and drinks hot or cold, as desired. For the sake of convenience and clarity, these ice chests, jugs, and bottles are generically referred to herein as coolers, recognizing that the insulated properties of these containers make them well suited for either hot or cold food or beverages. Coolers come in many different sizes and configurations.

One common use of a cooler is on a family picnic to a park. When the family arrives at the park, all of the picnic supplies must be unloaded from the vehicle and carried to the desired picnic area. Typically this involves many trips back and forth between the vehicle and the picnic area. One trip is generally required to carry the cooler, which may contain meat and condiments that need to be kept cold. Additional trips are also required to carry the other picnic supplies that do not have to be kept cold, such as chips and buns.

There are known coolers and attachments to coolers that provide pockets for carrying things. Examples of these are disclosed in the following U.S. Pat. Nos. 5,445,276 issued 8/29/95 to Gordon; 4,640,392 issued 2/3/87 to Decker et al. and assigned to Igloo Corporation; 4,468,933 issued 9/4/84 to Christopher; and Des. 316,012 issued 4/9/91 to Christopher. The two patents to Christopher disclose coolers that are manufactured with pockets. The configuration in the Christopher patents would require a consumer that wants pockets on a cooler to purchase a new cooler. While special-purpose coolers with pockets may be useful for the first-time buyer of a cooler, there are literally millions of coolers that are currently in use. Owners of existing coolers could greatly benefit from a separate attachment that could be purchased and fitted on the cooler at home by the user. In addition, known coolers and tote devices generally have relatively small pockets, allowing a person to store sunglasses, sunblock, or similar small items in these pockets, but none allow for the toting of large items.

Therefore, there existed a need for a multi-pocketed tote apparatus that has relatively large pockets and that may be easily retro-fitted onto an existing cooler.

DISCLOSURE OF INVENTION

According to the present invention, a cooler tote apparatus and method can be attached to existing coolers. This tote apparatus allows toting a relative large quantity of items external to the cooler when the cooler is carried. Expandable pockets provide for large storage space when the pockets are placed in their expanded position. One or more elastic portions allow the tote apparatus to be fitted on existing coolers of different sizes.

BRIEF DESCRIPTION OF DRAWINGS

The preferred exemplary embodiment of the present invention will hereinafter be described in conjunction with the appended drawings, where like designations denote like elements, and.

MODES FOR CARRYING OUT THE INVENTION

A tote apparatus in accordance with the preferred embodiments of the present invention may be easily fitted on an existing cooler. The tote apparatus includes one or more elastic portions that allow the tote apparatus to be fitted on a number of coolers of different sizes. For each embodiment disclosed herein, two different configurations of the tote are shown, one for a rectangular cooler and a second for a circular cooler. The specific configurations shown in the figures and discussed herein are shown and discussed to illustrate the salient features of the invention, and are not intended to be limiting.

Figure 1:
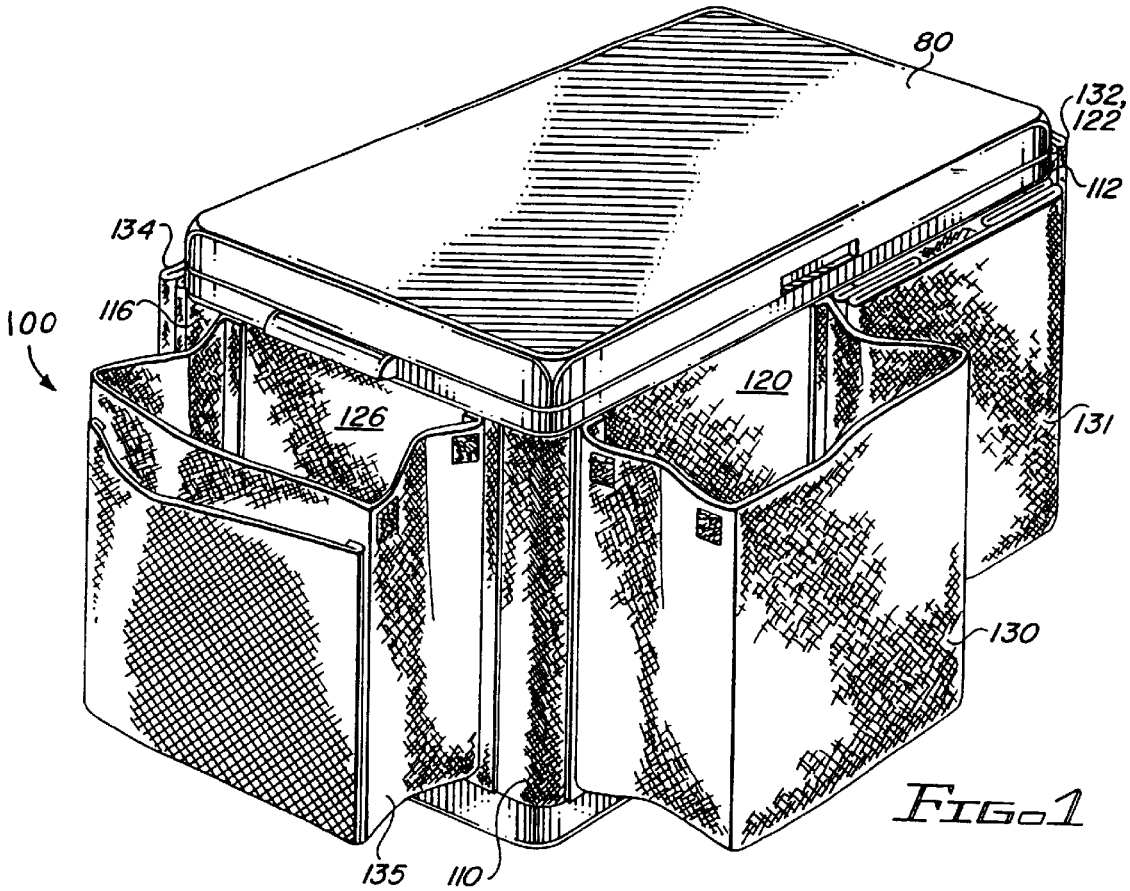
FIG. 1 is a perspective view of a multi-pocketed tote apparatus in accordance with a first embodiment of the present invention in use on a rectangular cooler.
Figure 2:
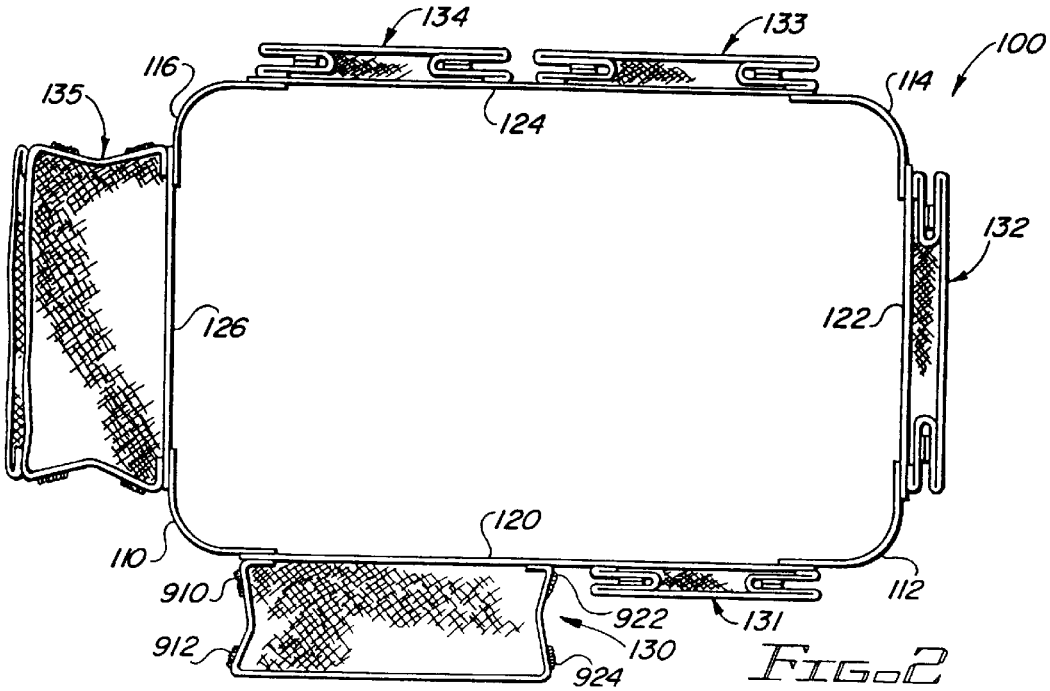
FIG. 2 is a top view of the tote apparatus of FIG. 1.

Referring to FIGS. 1 and 2, a tote apparatus 100 for a rectangular cooler 80 provides pockets 130–135 for carrying items external to the cooler. Tote apparatus 100, when configured for a rectangular cooler, suitably comprises a front panel 120, a right side panel 122, a back panel 124, a left side panel 126, and elastic portions 110, 112, 114, and 116 at each corner. Elastic portions 110–116 are made of an elastic material that allows stretching, such as an elastic fabric. Panels 120–126 in the preferred embodiment are non-stretchable material such a non-elastic fabric, but alternative embodiments may include an elastic material for one or more of panels 120–126. Front panel 120 and right side panel 122 are attached to elastic portion 112, and the other elastic portions 110, 114, and 116 are attached to their adjacent panels in similar fashion. Pockets 130 and 131 are attached to front panel 120, and the other pockets 132–135 are attached to their adjacent panels in similar fashion. Pockets 130–135 include one or more expandable pockets for carrying a relatively large quantity of items external to the cooler when carrying (i.e., transporting) the cooler.

Figure 9:
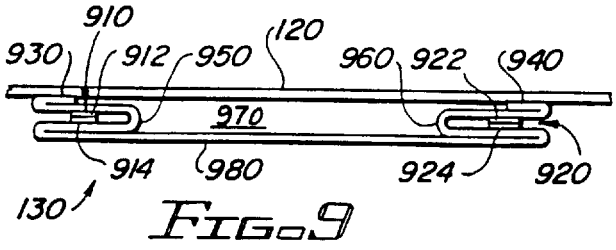
FIG. 9 is a top view of an expandable pocket of the preferred embodiments in its closed (unexpanded) position.
Figure 10:
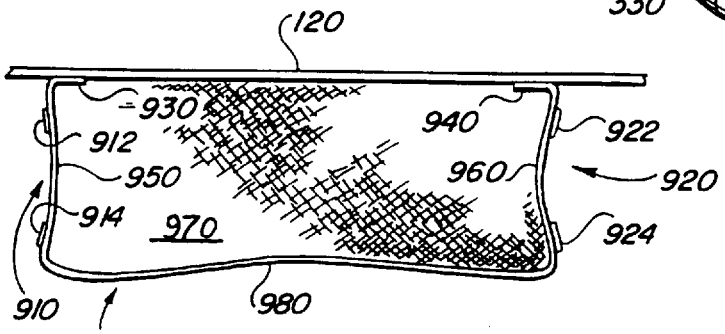
FIG. 10 is a top view of the expandable pocket of FIG. 9 in its open (expanded) position.

Referring to FIGS. 9 and 10, expandable pocket 130 has a front portion 980 coupled to two side portions 950 and 960 and a bottom portion 970. In the preferred embodiment, these different portions 950, 960, 970 and 980 are all formed from a single sheet of fabric, which is attached to front panel 120 at portions 930 and 940. Side portion 950 includes two complementary fastener parts 912 and 914 of a hook and loop type fastener 910. For example, 912 could be the hook part, and 914 could be the loop part of the fastener. Fastener portions 912 and 914 are disposed on side portion 950 in registration with each other that bring the two together when pocket 130 is collapsed to its non-expanded position to hold pocket 130 in its non-expanded position, as shown in FIG. 9. A similar fastener 920 with fastener portions 922 and 924 are attached to side portion 960. Pocket 130 may be expanded to its expanded position by separating fastener part 912 from fastener part 914 and by separating fastener part 922 from fastener part 924. Pocket 130 then expands to its expanded position, as shown in FIG. 10. The preferred fasteners 910 and 920 for pocket 130 are hook and loop type fasteners, but any suitable releasable fastenener (e.g., snaps, zippers, etc.) could be used within the scope of the invention.

Tote apparatus 100 includes one or more elastic portions that allow fitting the apparatus on coolers of different sizes. In addition, tote apparatus 100 includes one or more fasteners (not shown) to attach tote apparatus 100 to cooler 80. The fasteners would preferably be releasable fasteners (e.g., hook and loop fasteners, snaps), to allow the tote apparatus 100 to be easily removed from cooler 80 (e.g., for storage or cleaning of tote apparatus 100) and re-attached to cooler 80 as desired. However, tote apparatus 100 may also be fastened to cooler 80 using a variety of more permanent techniques (e.g., gluing, riveting, screwing).

While FIG. 1 illustrates each pocket 130–135 as being expandable, nonexpandable pockets are also contemplated within the scope of the invention. Thus, tote apparatus 100 may include any combination of expandable or non-expandable pockets, in any suitable configuration on apparatus 100.

The attachment of the various panels (120–126), elastic portions (110–116), and pockets (130–135) to each other may be accomplished using any suitable method. Known methods for attaching different portions of tote apparatus 100 include sewing, riveting, snaps, hook and loop type fasteners, and zippers, but may also include any other suitable method for joining together these various portions, whether the method of attachment is currently known or is developed in the future.

Figure 3:
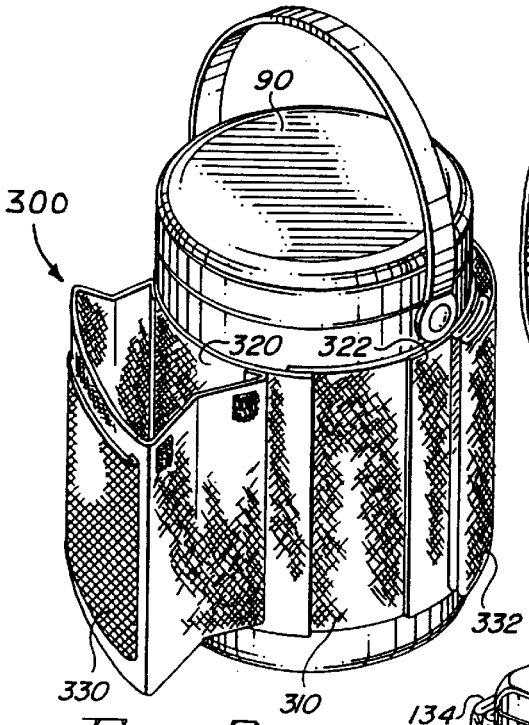
FIG. 3 is a perspective view of a multi-pocketed tote apparatus in accordance with the first embodiment in use on a circular cooler.
Figure 4:
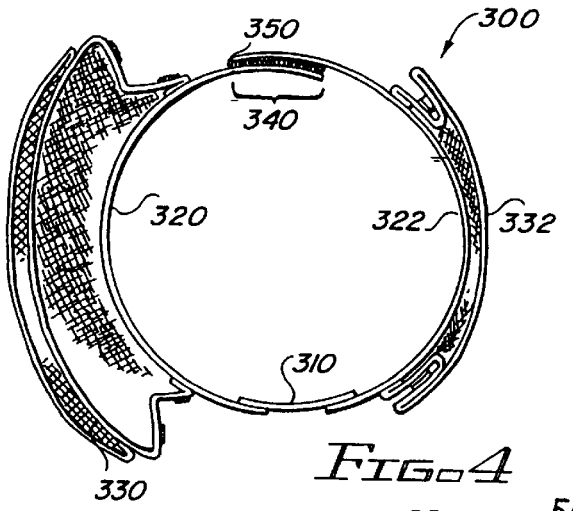
FIG. 4 is a top view of the tote apparatus of FIG. 3.

Referring to FIGS. 3 and 4, a tote apparatus 300 in accordance with the first embodiment for a cylindrical cooler 90 provides pockets 330 and 332 for carrying items external to the cooler. Two side panels 320 and 322 have an elastic portion 310 interposed between them, and have an overlapping region 340 defined by opposing portions of a hook and loop type fastener 350. In this manner, tote apparatus 300 may be wrapped around a cylindrical cooler 90, and once the elastic is stretched somewhat, the opposing portions of the hook and loop fastener 350 are pressed together to hold tote apparatus 300 in place. In an alternative embodiment, side panels 320 and 322 may be formed by the same panel without providing a hook and loop fastener 350. With such an embodiment, tote apparatus 300 would be slipped over the top or bottom of cooler 90 and slid to its proper position.

Figure 5:
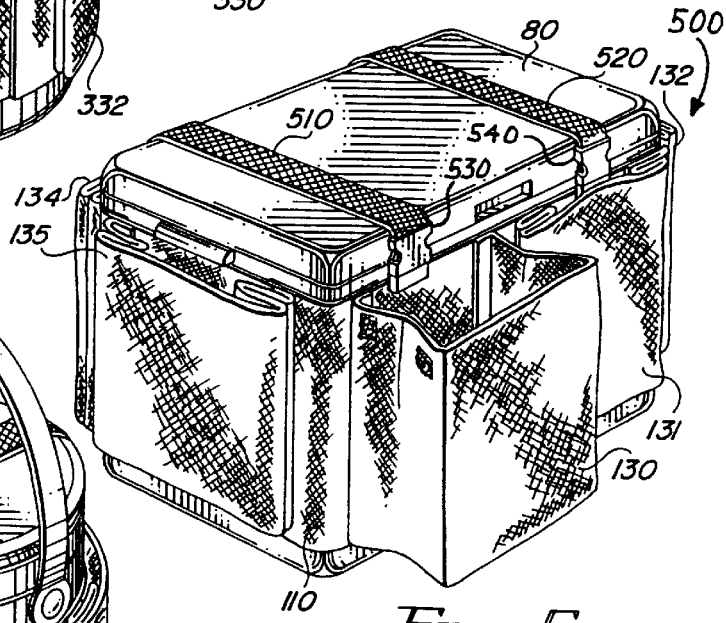
FIG. 5 is a perspective view of a multi-pocketed tote apparatus in accordance with a second embodiment of the present invention in use on a rectangular cooler.
Figure 6:
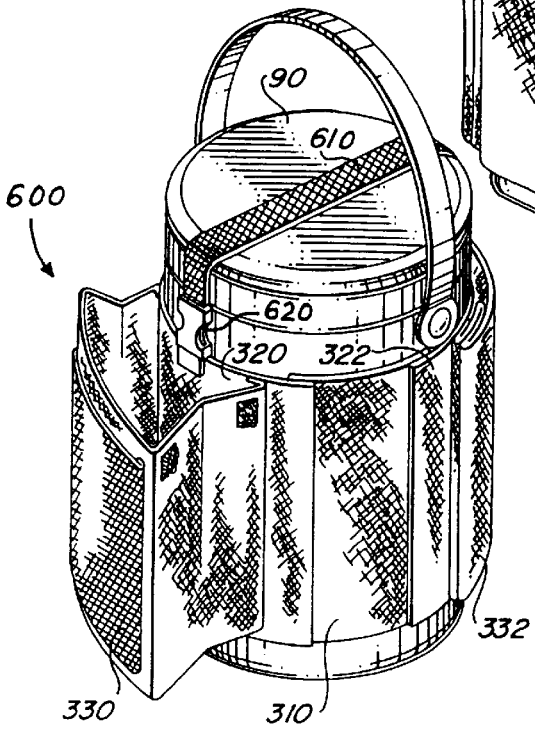
FIG. 6 is a perspective view of a multi-pocketed tote apparatus in accordance with the second embodiment in use on a circular cooler.

Referring to FIG. 5, according to a second embodiment of the invention, a tote apparatus 500 for a rectangular cooler includes one or more straps (e.g., 510 and 520) to secure tote apparatus 500 to cooler 80. The preferred material for the straps is a heavy webbing material, but straps may be made of any suitable material, whether currently known or not. Referring to FIG. 6, tote apparatus 600 for a circular cooler in accordance with the second embodiment includes one or more straps (e.g., 610) to secure tote apparatus 600 to cooler 90. Straps 510 and 520 of FIG. 5 are representative of one suitable strap configuration, passing over the lid of cooler 80 and including plastic snap buckles 530 and 540 to release strap 510, allowing the cooler lid to be opened. With strap 510 passing over the lid (as shown in FIG. 5), a relatively large volume and weight may be carried by tote apparatus 500, because all or part of the weight is supported by straps 510 and 520.

Referring to FIG. 6, according to the second embodiment, a tote apparatus 600 for a cylindrical cooler 90 includes one or more straps (e.g., 610) to secure tote apparatus 600 to cooler 90. Strap 610 includes a plastic snap buckle 620, allowing strap 610 to be easily released when the lid of cooler 90 needs to be opened, and allowing strap 610 to be easily reattached when the lid of cooler 90 is closed.

The straps disclosed herein (e.g., 510, 520 and 610) are shown as having plastic snap buckles that join and release the straps. However, any strap that attaches to the front and back of the tote apparatus and passes over the lid may be used. For example, a single strap piece that is attached to the tote apparatus using removable fasteners on one or both ends may be used. The function of the strap(s) is to hold the tote apparatus in place on the cooler, especially when fully loaded. Thus, the tote apparatus may be placed on the cooler and secured by the straps (after the food items are placed in the cooler). In this manner the tote apparatus is firmly secured to the cooler when carried. When the cooler with tote apparatus is put down for use, the straps are quickly and easily removed. For the specific example shown in FIGS. 5 and 6, the strap is removed by squeezing the plastic buckle to release the two buckle halves from each other. These plastic buckles are commonly used on backpacks and other outdoor equipment, and are well known in the art. When the cooler is to be carried again, the tote apparatus is first secured by closing the lid of the cooler and securing the strap across the lid so the strap bears some of the weight of the tote apparatus.

Figure 7:
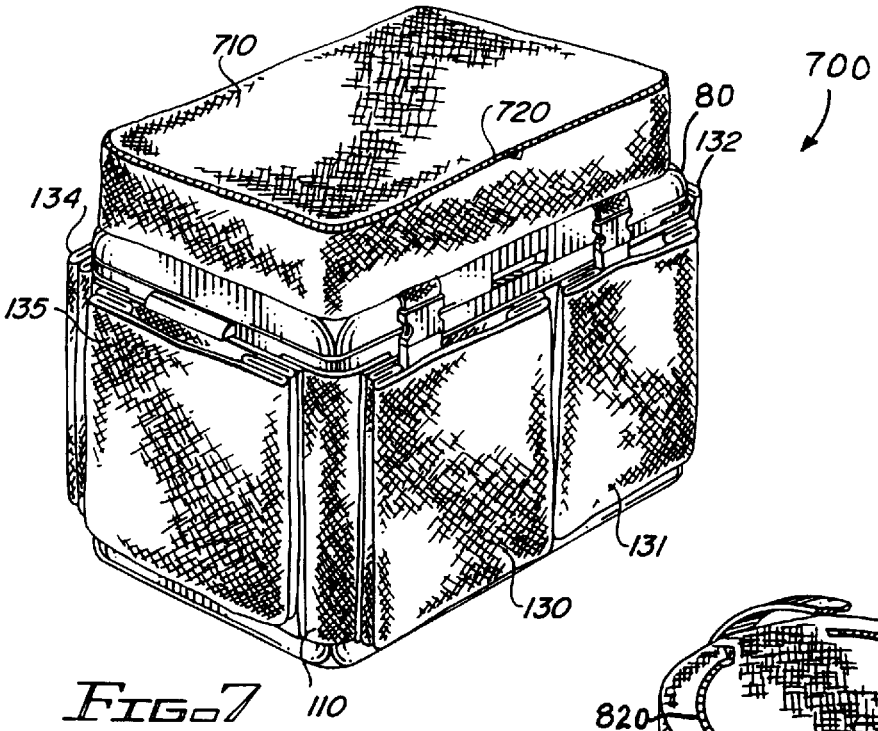
FIG. 7 is a perspective view of a multi-pocketed tote apparatus in accordance with a third embodiment of the present invention in use on a rectangular cooler.
Figure 8:
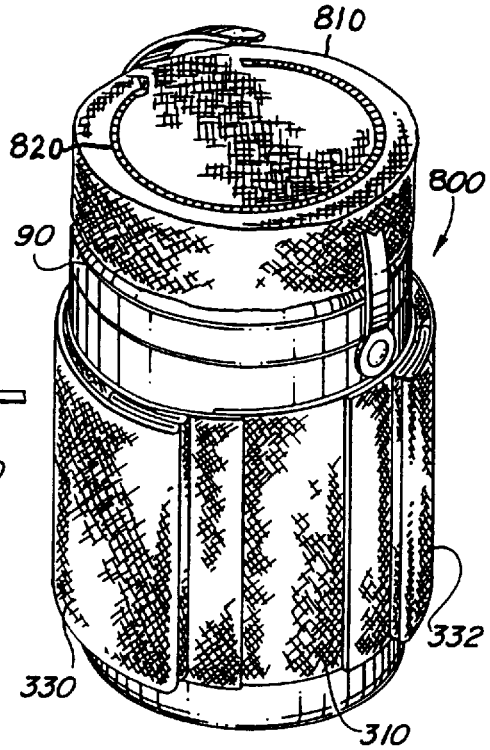
FIG. 8 is a perspective view of a multi-pocketed tote apparatus in accordance with the third embodiment in use on a circular cooler.

The tote apparatus in accordance with a third embodiment includes a top pocket member that is secured to the lid of the cooler. Referring to FIG. 7, tote apparatus 700 includes a top pocket member 710 that is placed atop the lid of cooler 80. Top pocket member 710 may be secured to the lid using any suitable fastener (e.g., hook and loop, snaps) or, in the alternative, if top straps are provided (such as shown in FIGS. 5 and 6), top pocket member 710 may be suitably attached to the straps by any suitable means, including both permanent fasteners (e.g., sewing) and releasable (e.g., hook and loop) fasteners. Top pocket member 710 is preferably attached in a manner that allows it to be released from the lid of cooler 80 for easier packing, unpacking, and cleaning, but it is equally within the scope of the invention to provide a fixed attachment to the lid (e.g., screws, rivets). In addition, top pocket member 710 includes a closure device (such as zipper 720) to provide access to an internal storage portion of top pocket member 710. Referring now to FIG. 8, in similar fashion, a tote apparatus 800 for a cylindrical cooler 90 includes a top pocket member 810 with a closure device 820.

In summary, the invention disclosed herein greatly simplifies any excursion that includes the use of a cooler by providing for supplemental storage space that is transported at the same time the cooler is transported from one place to the next. Expandable pockets provide for greater storage space, straps more surely secure the tote apparatus to the cooler, and a top pocket member increases the storage capacity. Our complicated and fast-paced world creates daily stress, and sometimes making the preparations to get away for some recreation is more stressful than even our everyday routine. While the tote apparatus disclosed herein may not change the world, it may succeed in making a picnic a little more simple and less stressful.

While the invention has been described in its preferred exemplary embodiment, it is to be understood that the words which have been used are words of description rather than limitation, and that changes may be made within the purview of the appended claims without departing from the true scope and spirit of the invention in its broader aspects.

What is claimed is:

1. A tote apparatus for a rectangular cooler having four sides and a lid, the tote apparatus comprising four panels of flexible material that is substantially non-elastic, each of the four panels substantially covering each of the four sides of the rectangular cooler;

four elastic portions interposed between the four panels such that the four elastic portions are at the corners of the rectangular cooler;

at least one pocket formed in at least one of the four panels for storing items external to the cooler.

2. The tote apparatus of claim 1, wherein the at least one pocket comprises:

at least one expandable pocket having two flexible side portions and a flexible bottom portion, the expandable pocket having expanded and collapsed positions, the flexible side portions and the flexible bottom portion being at least partially collapsed when the expandable pocket is in the collapsed position, the flexible side portions and flexible bottom portion being substantially non-collapsed when the expandable pocket is in the expanded position; and at least one releasable fastener attached to at least one of the side portions of the expandable pocket for retaining the expandable pocket in the collapsed position.

3. The tote apparatus of claim 1 further comprising at least one strap attached to at least one of the four panels to pass over the lid and at least partially support the tote apparatus when transporting the cooler.

4. The tote apparatus of claim 1 further comprising at least one top pocket member disposed to rest on the lid.

5. A tote apparatus for a rectangular cooler having four sides forming four corners and a lid, the tote apparatus comprising:

at least four panels of flexible material that is substantially non-elastic;

at least four elastic portions attached to the four panels and interposed between the four panels such that the four elastic portions are at the corners of the rectangular cooler in a manner that permits fitting the tote apparatus around the external perimeter of the cooler;

at least one expandable pocket formed in the at least one panel for storing items external to the cooler, the expandable pocket having two flexible side portions and a flexible bottom portion, the expandable pocket having expanded and collapsed positions, the flexible side portions and the flexible bottom portion being at least partially collapsed when the expandable pocket is in the collapsed position, the flexible side portions and flexible bottom portion being substantially non-collapsed when the expandable pocket is in the expanded position;

at least one releasable fastener attached to at least one of the side portions of the expandable pocket for retaining the expandable pocket in the collapsed position; and at least one strap attached to at least two of the four panels to pass over the lid and at least partially support the tote apparatus when transporting the cooler.

6. The tote apparatus of claim 5 wherein the tote apparatus further comprises at least one top pocket member attached to the at least one strap, the top pocket member disposed to rest on the lid.

7. A cooler and tote apparatus combination comprising:

(A) a rectangular having four sides with an external perimeter and a lid; and (B) a tote apparatus comprising:

four panels that each substantially cover each of the four sides of the rectangular cooler;

four elastic portions interposed between the four panels such that the four elastic portions are at the corners of the rectangular cooler; and at least one pocket formed in the at least one panel for storing items external to the cooler.

* * * * *